US012723762B2

(12) United States Patent
Santana et al.

(10) Patent No.: US 12,723,762 B2
(45) Date of Patent: Sep. 1, 2026

(54) ADJUSTING PREHEATING PARAMETERS FOR COOKING APPLIANCES

(71) Applicant: Haier US Appliance Solutions, Inc., Wilmington, DE (US)

(72) Inventors: Omar Santana, Louisville, KY (US); Pirapat Kitipongpatana, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 707 days.

(21) Appl. No.: 18/308,245

(22) Filed: Apr. 27, 2023

(65) Prior Publication Data

US 2024/0361003 A1 Oct. 31, 2024

(51) Int. Cl.
*F24C 7/08* (2006.01)
*F24C 7/06* (2006.01)

(52) U.S. Cl.
CPC ..... *F24C 7/088* (2013.01); *F24C 7/062* (2013.01); *F24C 7/086* (2013.01)

(58) Field of Classification Search
CPC ..... H05B 6/062; H05B 1/0261; H05B 6/687; H05B 6/12; H05B 1/0266; H05B 2213/07; H05B 3/748; H05B 1/0263; H05B 6/1209; H05B 2213/04
USPC ..... 219/391, 625, 627; 99/326, 328, 332
See application file for complete search history.

(56) References Cited

U.S. PATENT DOCUMENTS

| | | | |
|---|---|---|---|
| 4,493,980 | A | 1/1985 | Payne et al. |
| 4,816,647 | A | 3/1989 | Payne |
| 5,767,488 | A | 6/1998 | Barger et al. |
| 6,381,518 | B1 | 4/2002 | Huffington et al. |
| 7,105,781 | B2 | 9/2006 | Wilkins et al. |
| 8,530,798 | B2 | 9/2013 | Arjol et al. |
| 8,796,599 | B2 | 8/2014 | Sakakibara et al. |
| 9,841,261 | B2 | 12/2017 | Raghavan et al. |
| 10,260,755 | B2 | 4/2019 | Bach |
| 10,641,497 | B2 | 5/2020 | Park et al. |
| 10,708,982 | B2 | 7/2020 | Frank et al. |
| 10,874,244 | B2 | 12/2020 | Vengroff |
| 11,009,238 | B2 | 5/2021 | Neal |
| 11,268,921 | B2 | 3/2022 | Steele et al. |
| 11,457,769 | B2 | 10/2022 | Swayne et al. |
| 11,782,464 | B2 | 10/2023 | Santana et al. |

(Continued)

FOREIGN PATENT DOCUMENTS

| | | |
|---|---|---|
| CN | 108628159 A | 10/2018 |
| CN | 110353473 A | 10/2019 |

(Continued)

*Primary Examiner* — Phuong T Nguyen
(74) *Attorney, Agent, or Firm* — Dority & Manning, P.A.

(57) ABSTRACT

A cooking appliance includes at least one heating element to selectively supply heat to a cookware item; and a controller operably connected with the at least one heating element, the controller configured to direct a heating operation. The heating operation includes a preheating phase and a cooking phase. The heating operation includes receiving a temperature setpoint for the cooking phase; determining at least one attribute for the at least one heating element for the preheating phase, the at least one attribute being based on the temperature setpoint; and initiating the preheating phase by directing the at least one heating element according to the at least one determined attribute.

14 Claims, 4 Drawing Sheets

(56) References Cited

U.S. PATENT DOCUMENTS

| | | | | |
|---|---|---|---|---|
| 2004/0262289 | A1* | 12/2004 | Sauter | F24C 7/082 219/483 |
| 2014/0157994 | A1 | 6/2014 | Ryan et al. | |
| 2022/0104656 | A1* | 4/2022 | Swayne | A47J 37/0641 |
| 2022/0308537 | A1* | 9/2022 | Neal | G05B 19/042 |

FOREIGN PATENT DOCUMENTS

| | | | |
|---|---|---|---|
| CN | 110687810 | A | 1/2020 |
| CN | 110701639 | A | 1/2020 |
| CN | 113701201 | A | 11/2021 |
| CN | 114719301 | A | 7/2022 |
| EP | 2123981 | B1 | 11/2010 |
| EP | 2339893 | B1 | 5/2016 |
| EP | 3510833 | B1 | 4/2022 |
| JP | 2005511122 | A | 4/2005 |
| JP | 2012106052 | A | 6/2012 |
| JP | 6037854 | B2 | 12/2016 |
| JP | 6753031 | B2 | 8/2020 |
| KR | 20130122265 | A | 11/2013 |
| KR | 101476727 | B1 | 12/2014 |
| WO | WO2018225162 | A1 | 12/2018 |

* cited by examiner

ADJUSTING PREHEATING PARAMETERS FOR COOKING APPLIANCES

FIELD OF THE INVENTION

The present subject matter relates generally to cooking appliances, and more particularly to cooking appliances incorporating cookware preheating.

BACKGROUND OF THE INVENTION

Cooking appliances generally have one or more heating elements configured for heating a cookware item. The cookware item, e.g., a pot or a pan, may be positioned on or near the one or more heating elements and food products (including, e.g., food solids, liquid, or water) may be placed inside the cookware item for cooking. A controller may selectively energize the heating element(s) to provide thermal energy to the cookware item and the food products placed therein. Alternatively, certain cooking appliances, often referred to as induction cooktops, provide energy in the form of an alternating magnetic field which causes the cookware item to generate heat. In both types of appliances, a controller selectively energizes either the heating element (s) or a magnetic coil to heat the food products until they are properly cooked.

Some cooking appliances incorporate temperatures controlling operations in which temperatures (e.g., of cookware items, food within cookware items, etc.) are maintained at a desired setpoint for the cooking operation. Such operations include a preheating phase in which the cookware item is brought up to a temperature setpoint before initiating the cooking phase. However, several preheating conditions may alter a result of the preheating operation negatively. For instance, automatically directing the heating unit at maximum power for preheating may result in the cookware item being too hot when initiating the cooking phase, which may negatively affect the outcome of the cooking operation. Moreover, having a single preheating approach for multiple temperature setpoints, multiple burners, and multiple cookware items unpredictably varies the outcome of the preheating phase. Some cooking appliances incorporate closed-loop cooking operations in which temperatures (e.g., of cookware items, food within cookware items, etc.) are monitored throughout the operation to maintain a consistent temperature. However, this method fails to account for varying and unpredictable temperature differences between the cookware item and the temperature sensor.

Accordingly, a cooking appliance that obviates one or more of the above-mentioned drawbacks would be beneficial. In particular, a cooking appliance that adjusts preheating parameters based on inputs would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a cooking appliance is provided. The cooking appliance may include at least one heating element to selectively supply heat to a cookware item; and a controller operably connected with the at least one heating element, the controller configured to direct a heating operation comprising a preheating phase and a cooking phase. Directing the heating operation may include receiving a temperature setpoint for the cooking phase; determining at least one attribute for the at least one heating element for the preheating phase, the at least one attribute being based on the temperature setpoint; and initiating the preheating phase by directing the at least one heating element according to the at least one determined attribute.

In another exemplary aspect of the present disclosure, a method of operating a cooking appliance is provided. The cooking appliance may include at least one heating element. The method may include receiving a temperature setpoint for a cooking operation, the cooking operation including a preheating phase and a cooking phase; determining at least one attribute for the at least one heating element for the preheating phase, the at least one attribute being based on the temperature setpoint; and initiating the preheating phase by directing the at least one heating element according to the at least one determined attribute.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
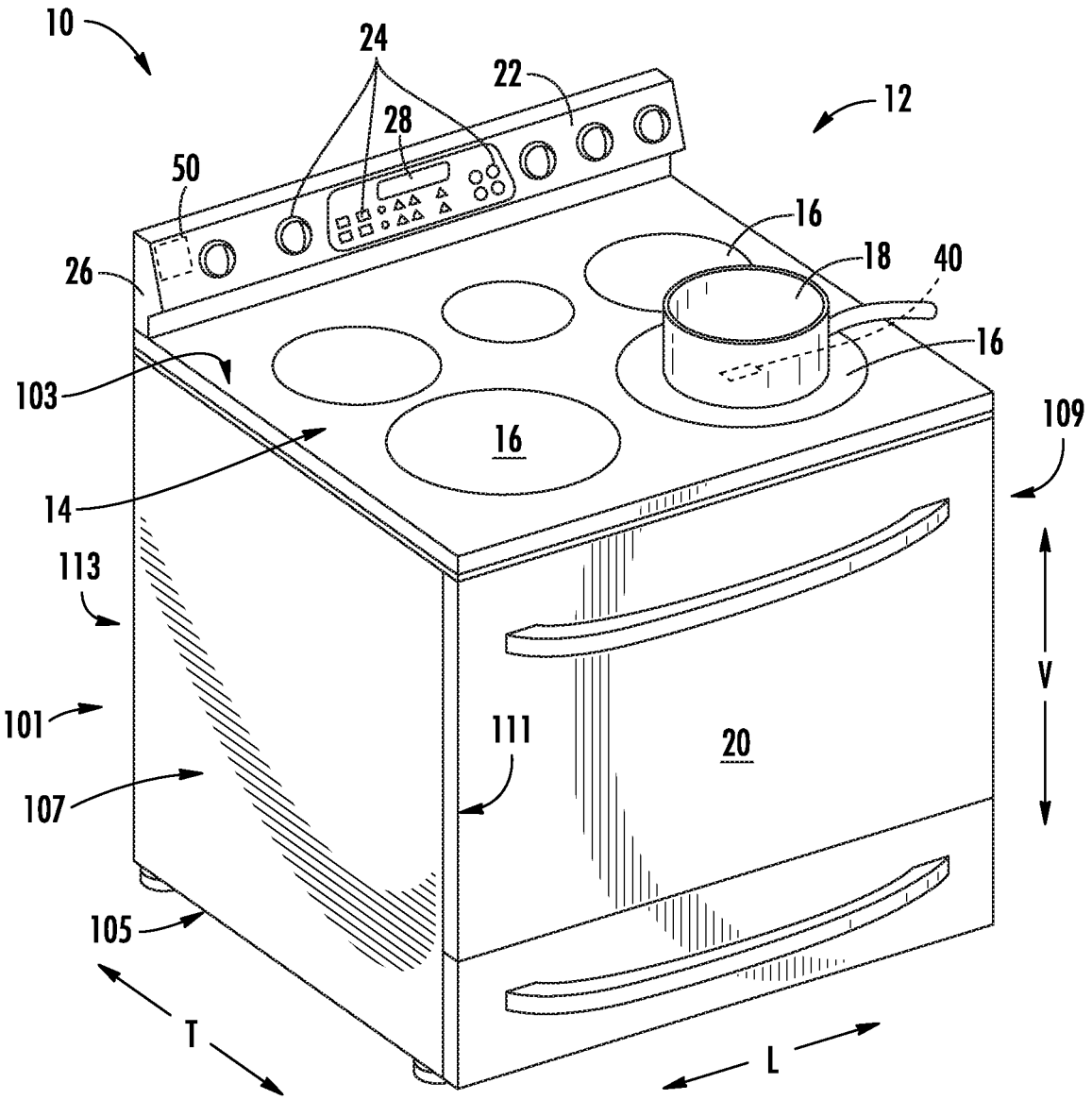
FIG. 1 provides a perspective view of an oven range according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
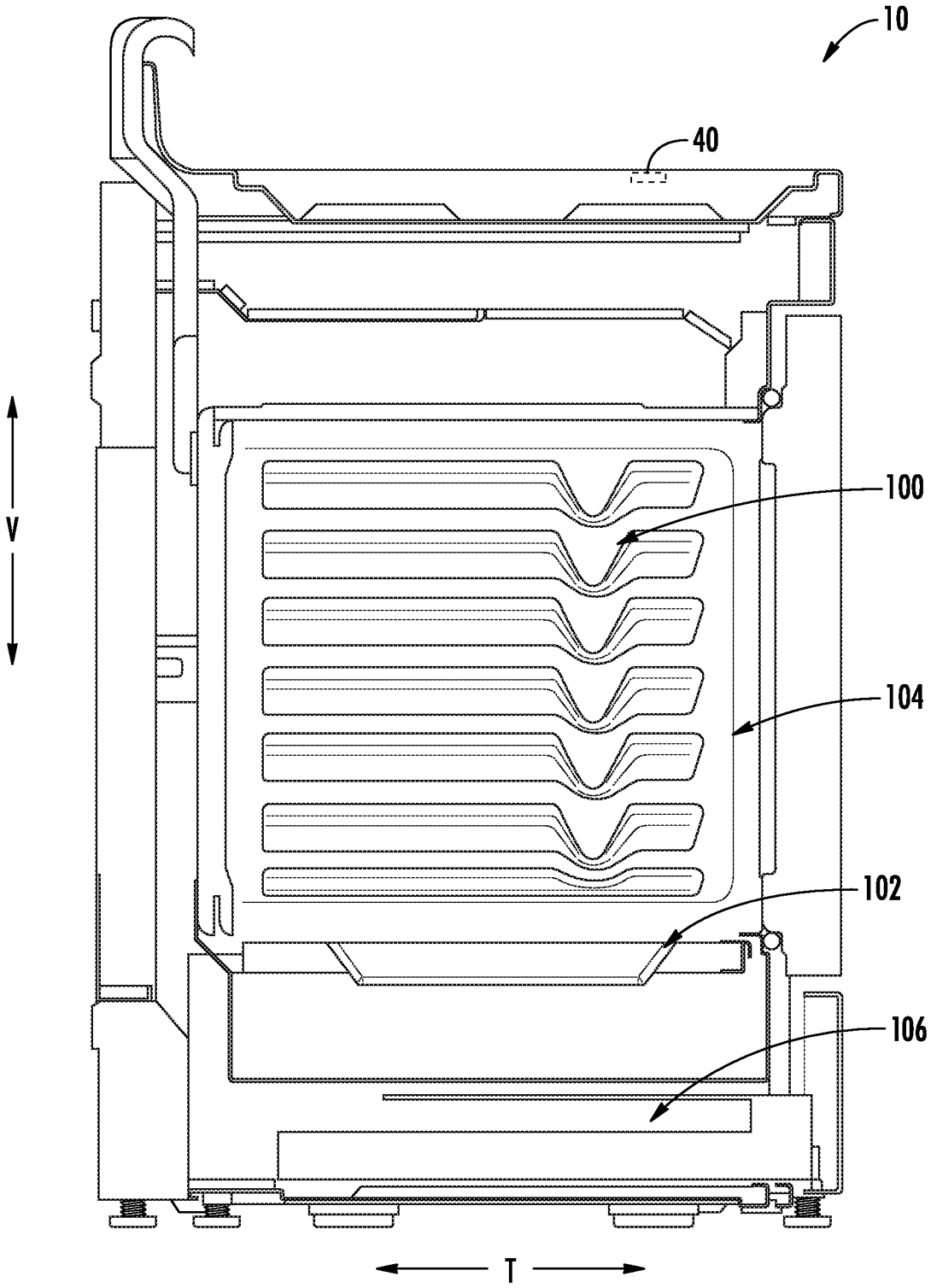
FIG. 2 provides a side cut-away view of the exemplary oven range of FIG. 1.

FIG. 1 provides a perspective view of a cooking appliance, or oven range 10, including a cooktop 12, and FIG. 2 provides a side cut-away view of the cooking appliance 10. Cooking appliance 10 is provided by way of example only and is not intended to limit the present subject matter to the arrangement shown in FIGS. 1 and 2. Thus, the present subject matter may be used with other range 10 and/or cooktop 12 configurations, e.g., double oven range appliances. As illustrated, cooking appliance 10 generally defines a vertical direction V, a lateral direction L, and a transverse direction T, each of which is mutually perpendicular, such that an orthogonal coordinate system is generally defined. Cooking appliance 10 may include a cabinet 101 that extends between a top 103 and a bottom 105 along the vertical direction V, between a left side 107 and a right side 109 along the lateral direction, and between a front 111 and a rear 113 along the transverse direction T.

A cooking surface 14 of cooktop 12 may include a plurality of heating elements 16. For the embodiment depicted, cooktop 12 includes five heating elements 16 spaced along cooking surface 14. Heating elements 16 may be electric heating elements and are positioned at, e.g., on or proximate to, the cooking surface 14. In certain exemplary embodiments, cooktop 12 is a radiant cooktop with resistive heating elements or coils mounted below cooking surface 14. However, in other embodiments, the cooktop appliance 12 includes other suitable shape, configuration, and/or number of heating elements 16, for example, cooktop 12 may be an open coil cooktop with heating elements 16 positioned on or above surface 14. Additionally or alternatively, in other embodiments, cooktop 12 may include any other suitable type of heating element 16, such as an induction heating element. Each of the heating elements 16 may be the same type of heating element 16, or cooktop 12 may include a combination of different types of heating elements 16.

As shown in FIG. 1, a cooking utensil (or cookware item) 18, such as a pot, pan, or the like, may be placed on a heating element 16 to heat the cookware item 18 and cook or heat food items placed within cookware item 18. Cooking appliance 10 may also include a door 20 that permits access to a cooking chamber 104 of oven range 10, e.g., for cooking or baking of food items therein. A control panel 22 having controls 24 may permit a user to make selections for cooking of food items. Although shown on a backsplash or back panel 26 of oven range 10, control panel 22 may be positioned in any suitable location.

Controls 24 may include buttons, knobs, and the like, as well as combinations thereof, and/or controls 24 may be implemented on a remote user interface device such as a smartphone. As an example, a user may manipulate one or more controls 24 to select a temperature and/or a heat or power output for each heating element 16 and the cooking chamber 104. The selected temperature or heat output of heating element 16 affects the heat transferred to cookware item 18 placed on heating element 16. A display 28 may be provided (e.g., on or in control panel 22). Display 28 may display information regarding cooking operations or inputs from a user regarding the cooking operation. Display 28 may be any suitable display capable of providing visual feedback, such as a liquid crystal display (LCD), a light emitting diode (LED) display, a segmented display, or the like. Additionally or alternatively, display 28 may be a touch display capable of receiving touch inputs from a user.

Cooktop appliance 12 may further include or be in operative communication with a processing device or a controller 50 that may be generally configured to facilitate appliance operation. In this regard, control panel 22, controls 24, and display 28 may be in communication with controller 50 such that controller 50 may receive control inputs from controls 24, may display information using display 28, and may otherwise regulate operation of cooking appliance 10. For example, signals generated by controller 50 may operate cooking appliance 10, including any or all system components, subsystems, or interconnected devices, in response to the position of controls 24 and other control commands. Control panel 22 and other components of appliance 10 may be in communication with controller 50 via, for example, one or more signal lines or shared communication busses. In this manner, Input/Output ("I/O") signals may be routed between controller 50 and various operational components of appliance 10.

As used herein, the terms "processing device," "computing device," "controller," or the like may generally refer to any suitable processing device, such as a general or special purpose microprocessor, a microcontroller, an integrated circuit, an application specific integrated circuit (ASIC), a digital signal processor (DSP), a field-programmable gate array (FPGA), a logic device, one or more central processing units (CPUs), a graphics processing units (GPUs), processing units performing other specialized calculations, semiconductor devices, etc. In addition, these "controllers" are not necessarily restricted to a single element but may include any suitable number, type, and configuration of processing devices integrated in any suitable manner to facilitate appliance operation. Alternatively, controller 50 may be constructed without using a microprocessor, e.g., using a combination of discrete analog and/or digital logic circuitry (such as switches, amplifiers, integrators, comparators, flip-flops, AND/OR gates, and the like) to perform control functionality instead of relying upon software.

Controller 50 may include, or be associated with, one or more memory elements or non-transitory computer-readable storage mediums, such as RAM, ROM, EEPROM, EPROM, flash memory devices, magnetic disks, or other suitable memory devices (including combinations thereof). These memory devices may be a separate component from the processor or may be included onboard within the processor. In addition, these memory devices can store information and/or data accessible by the one or more processors, including instructions that can be executed by the one or more processors. It should be appreciated that the instructions can be software written in any suitable programming language or can be implemented in hardware. Additionally, or alternatively, the instructions can be executed logically and/or virtually using separate threads on one or more processors.

For example, controller 50 may be operable to execute programming instructions or micro-control code associated with an operating cycle of cooking appliance 10. In this regard, the instructions may be software or any set of instructions that when executed by the processing device, cause the processing device to perform operations, such as running one or more software applications, displaying a user interface, receiving user input, processing user input, etc. Moreover, it should be noted that controller 50 as disclosed herein is capable of and may be operable to perform any methods, method steps, or portions of methods as disclosed herein. For example, in some embodiments, methods disclosed herein may be embodied in programming instructions stored in the memory and executed by controller 50.

The memory devices may also store data that can be retrieved, manipulated, created, or stored by the one or more processors or portions of controller 50. The data can include, for instance, data to facilitate performance of methods described herein. The data can be stored locally (e.g., on controller 50) in one or more databases and/or may be split up so that the data is stored in multiple locations. In addition, or alternatively, the one or more database(s) can be connected to controller 50 through any suitable network(s), such as through a high bandwidth local area network (LAN) or wide area network (WAN). In this regard, for example, controller 50 may further include a communication module or interface that may be used to communicate with one or more other component(s) of appliance 10, controller 50, an external appliance controller, or any other suitable device, e.g., via any suitable communication lines or network(s) and using any suitable communication protocol. The communication interface can include any suitable components for interfacing with one or more network(s), including for example, transmitters, receivers, ports, controllers, antennas, or other suitable components.

Cooking appliance 10 may include a temperature sensor 40. Temperature sensor 40 may be configured to selectively sense a temperature of a cookware item (e.g., cookware item 18) as it is heated. For instance, temperature sensor 40 may be integrally formed with cooking appliance 10 (e.g., within cooktop 12, within cooking chamber 104, etc.). In some embodiments, temperature sensor 40 is operably connected to cooking appliance 10 (e.g., via a port or socket, via a remote connection, etc.). For one example, temperature sensor 40 is provided within cookware item 18 and operably connected to controller 50 during a cooking operation. Temperature sensor 40 may monitor a temperature of cookware item 18 or a food item provided within cookware item 18. Accordingly, temperature sensor 40 may deliver signals (e.g., voltage signals) representing the temperature of cookware item 18 to controller 50. The signals may be sent according to a predetermined frequency (e.g., at predetermined time intervals). Thus, controller 50 may analyze a temperature or temperature change of cookware item 18.

As used herein, "temperature sensor" or the equivalent is intended to refer to any suitable type of temperature measuring system or device positioned at any suitable location for measuring the desired temperature. Thus, for example, temperature sensor 40 may be any suitable type of temperature sensor, such as a thermistor, a thermocouple, a resistance temperature detector, a semiconductor-based integrated circuit temperature sensor, etc. In addition, temperature sensor 40 may be positioned at any suitable location and may output a signal, such as a voltage, to a controller that is proportional to or indicative of the temperature being measured. Although exemplary positioning of temperature sensors is described herein, it should be appreciated that appliance 10 may include any other suitable number, type, and position of temperature or other sensors according to alternative embodiments.

Figure 3:
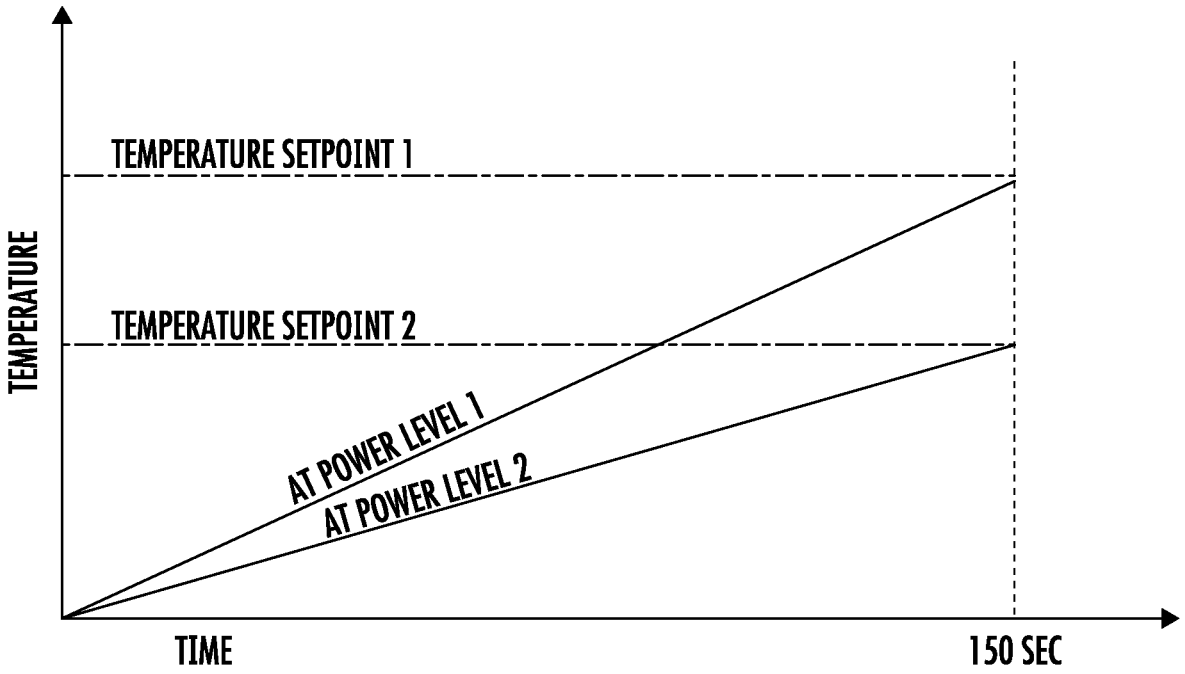
FIG. 3 provides a graph illustrating a temperature change of a cookware item based on a power level of a heating element over a length of time.

Referring now to FIG. 3, a graph illustrating temperature changes of a cookware item over a predetermined period of time according to a power level applied to a heating element based on a temperature setpoint is shown. The predetermined period of time may be a preheating phase of a cooking operation. In detail, the temperature changes according to two distinct power levels are shown in FIG. 3. According to at least one example, a first cooking operation may include a first temperature setpoint, and a second cooking operation may include a second temperature setpoint. According to this example, the first temperature setpoint is greater than the second temperature setpoint (e.g., 400° F. and 200° F.). As will be explained further below, in order to reach the first temperature setpoint, a preheating phase may drive the heating element at a first power level. Similarly, in order to reach the second temperature setpoint, the preheating phase may drive the heating element at a second power level. As would be understood, the first power level may be greater than the second power level.

Figure 4:
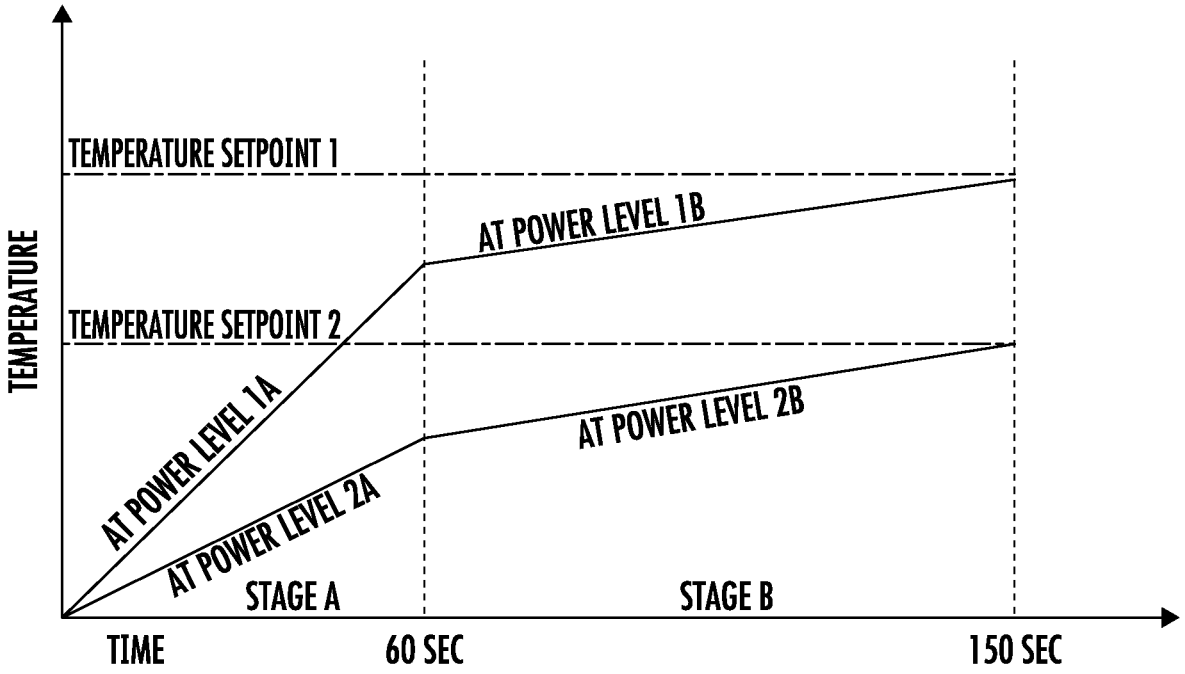
FIG. 4 provides a graph illustrating a temperature change of a cookware item based on multiple power levels of a heating element over a length of time.
Figure 5:
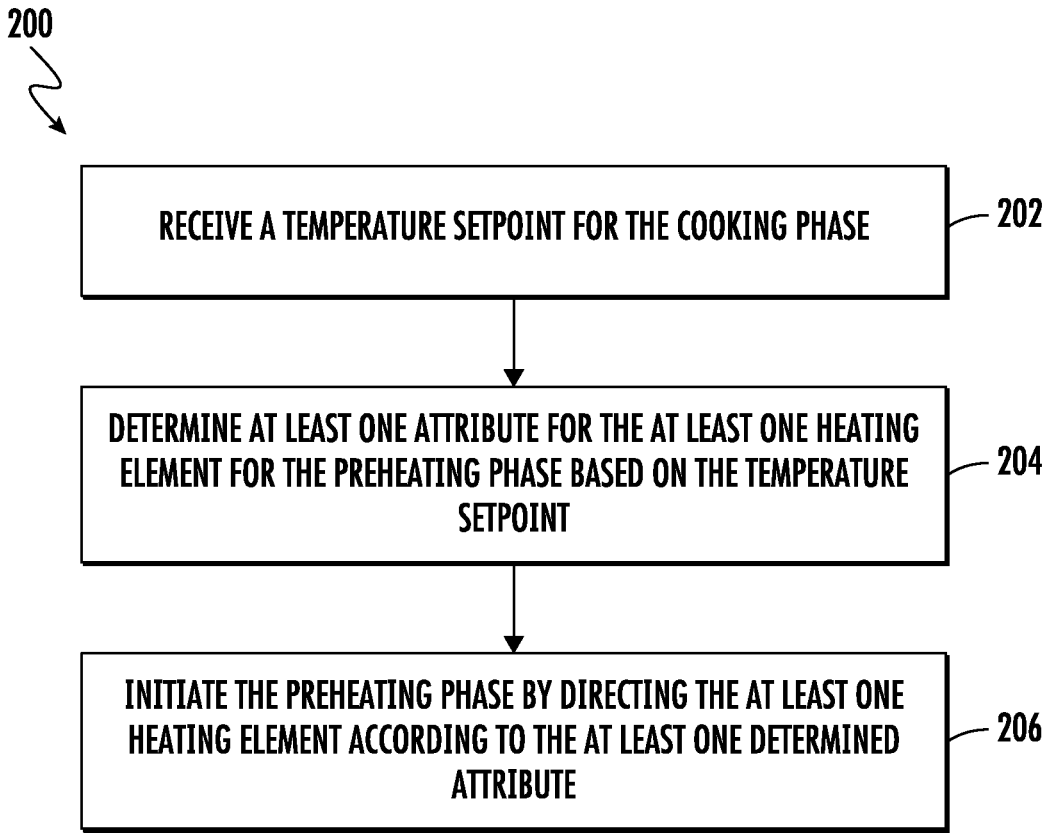
FIG. 5 provides a flow chart illustrating a method of operating a cooking appliance according to an exemplary embodiment.

FIG. 4 provides another embodiment illustrating temperature changes of a cookware item over a predetermined period of time according to multiple power levels applied to a heating element based on a temperature setpoint. According to this embodiment, the preheating phase may be divided into two stages (e.g., stage A and stage B). Stage A may be a first portion of the preheating phase. Stage B may be a second portion of the preheating phase (e.g., following stage A). The stages described herein are presented by way of example only, and any number of stages of the preheating phase may be incorporated. For instance, the preheating phase may include three, four, five, or more stages. The first temperature setpoint and the second temperature setpoint may be similar to the first and second temperature setpoints of FIG. 3. As is shown, the first power level for the heating element may be divided into a stage A power level and a stage B power level. The stage A power level may be greater than the stage B power level. Thus, for stage A, the heating element may be driven according to a 1A power level (e.g., a first stage power level). After a predetermined amount of time (e.g., the conclusion of stage A), the heating element may be driven according to a 1B power level (e.g., a second stage power level). According to this example, the 1A power level is greater than the 1B power level. Advantageously, the cookware item provided on the heating element may avoid overshoot in temperature by having the power level reduced for stage B of the preheating phase. As would be understood, the power levels according to the preheating phase for the second temperature setpoint operate similarly to the power levels according to the preheating phase for the first temperature setpoint. However, in some instances, the stage A power level may be less than the stage B power level. Additionally or alternatively, in the instance of three or more stages, power levels for each stage may alternate (e.g., stage A higher than stage B, stage B lower than stage C, etc.).

Now that the construction of cooking appliance 10 and a configuration of controller 50 according to exemplary embodiments have been presented, exemplary method 200 of operating a cooking appliance will be described. Although the discussion below refers to the exemplary method 200 of operating cooking appliance 10, one skilled in the art will appreciate that the exemplary method 200 is applicable to the operation of a variety of other cooking appliances. In exemplary embodiments, the various method steps as disclosed herein may be performed by controller 50 or a separate, dedicated controller. Additionally or alternatively, the various method steps may be performed in a different order, including additional steps or omitting certain steps according to specific embodiments.

At step 202, method 200 may include receiving a temperature setpoint for a cooking phase. In detail, a cooking appliance (e.g., cooking appliance 10) may receive instructions to initiate a heating (or cooking) operation. The heating operation may include a preheating phase and a cooking phase following the preheating phase. The instructions may include a temperature setpoint input from a user. The user may manually enter a temperature setpoint (e.g., a temperature at which the user desires to have the item cooked). Thus, using a user interface (e.g., control panel 22), the user may enter a specific cooking temperature as the temperature setpoint (e.g., 250° F., 300° F., 350° F., etc.). In additional or alternative embodiments, the user may provide information regarding a specific food item to be cooked (e.g., eggs, meat, vegetables, etc.). For instance, the cooking appliance may include features for selecting predetermined food items from the user interface or the cooking appliance may include a remote connectivity (e.g., wireless fidelity [WiFi], Bluetooth®, etc.), through which the user may select a food item (e.g., via a remote device). Further still, the user may input a particular recipe to be cooked on or in the cooking appliance. The temperature setpoint may be stored within the cooking appliance (e.g., within a controller or a memory therein).

At step 204, method 200 may include determining at least one attribute for the at least one heating element for the preheating phase based on the temperature setpoint. For instance, upon receiving (or determining) the temperature setpoint for the cooking operation, operational parameters for the heating element may be determined or calculated to bring a cookware item receiving heat from the heating element up to the temperature setpoint. The at least one attribute may include a power level of the at least one heating element, a timespan of the preheating phase, or the like.

According to some embodiments, the at least one attribute for the at least one heating element is the power level of the heating element. In detail, the method 200 may determine the power level at which to drive the heating element over the preheating phase. The power level may be retrieved from a lookup table, for instance. As shown below, the lookup table may include a plurality of power levels associated with a plurality of temperature setpoints:

| Temperature Setpoint [° F.] | Preheat Power [%] | Preheat Duration [sec] |
|---|---|---|
| 100 | 4 | 150 |
| 150 | 10 | 150 |
| 250 | 22 | 150 |
| 350 | 30 | 150 |
| 450 | 39 | 150 |

Thus, as can be seen, the power level may be retrieved (e.g., from the lookup table) according to the temperature setpoint. In some instances, the associated power level is proportionate to the temperature setpoint. For instance, as the temperature setpoint increases, the power level increases as well. Additionally or alternatively, the preheat duration may remain constant for each temperature setpoint (and preheat power level).

A plurality of lookup tables may be included (e.g., within an onboard memory within the cooking appliance). For instance, a specific and unique lookup table may be provided for each of a plurality of heating elements included with the cooking appliance. Thus, a first heating element may be associated with a first lookup table, a second heating element may be associated with a second lookup table, and so on. The plurality of heating elements may include cooktop burners (e.g., gas burners, electric coils, glasstop burners, etc.), oven heating elements (e.g., bake elements or burners, broil elements, convection heating elements, etc.), microwave heating elements (e.g., magnetrons), toaster heating elements, or the like. Accordingly, specific preheating power levels may be provided for individual heating elements exhibiting unique heating properties.

In additional or alternative embodiments, the preheat power level may be determined according to one or more equations. For instance, the temperature setpoint may be a specific temperature not included within the lookup table. Thus, the method 200 may include interpolating the preheating power level according to two or more known power levels. For one example, a temperature setpoint is 325° F. The lookup table may include associated preheating power levels for 300° F. and 350° F. The determined preheating power level for the 325° F. temperature setpoint may thus be interpolated from the preheating power level at 300° F. and the preheating power level at 350° F. As would be understood, the interpolation may be linear interpolation or nonlinear interpolation. Additional equations or calculations may be made in determining the appropriate preheating power level for the selected heating element.

According to another embodiment, the at least one attribute for the at least one heating element includes a preheating phase duration. In detail, the method 200 may determine a total preheating duration upon receiving the temperature setpoint. The total preheating duration may be based on the temperature setpoint (e.g., directly proportional). Accordingly, the method 200 may incrementally increase the preheating phase duration as the temperature setpoint is increased. Further still, the at least one attribute for the at least one heating element may include each of the preheating power level and the preheating phase duration. For instance, upon receiving the temperature setpoint, the method 200 may determine (or retrieve) the associated preheating power level. The method 200 may further determine (e.g., calculate or retrieve) the preheating phase duration associated with the determined preheating power level.

According to yet another embodiment, the preheating phase may include a plurality of stages. For instance, the preheating phase may include a first stage and a second stage following the first stage. It should be understood that the preheating phase may include any suitable number of stages as specific instances warrant, and the disclosure is not limited to the examples given and described herein. The first stage (stage A) may include a first set of attributes for the heating element while the second stage (stage B) includes a second set of attributes for the heating element.

As described above (and with reference again to FIG. 4), stage A may have a first duration and stage B may have a second duration. The first duration may be different from the second duration. For instance, the first duration may be shorter than the second duration. As mentioned above, additional stages may be included as well, each additional stage having a duration (e.g., a unique duration or a duration equal to that of one or more of the other durations).

Moreover, each individual stage may include a unique power level. In detail, with references again to FIG. 4, stage A may be associated with a first determined power level (power level 1A) while stage B is associated with a second determined power level (power level 1B). In some instances, the first determined power level (e.g., power level 1A) is greater than the second determined power level (e.g., power level 1B). Advantageously, the cookware item may be preheated in multiple stages to reach the temperature setpoint while avoiding egregious overshoot. As would be understood, however, the first determined power level may be less than the second determined power level. Additionally or alternatively, the first duration may be longer than the second duration.

As with the example given above in which the preheating power level is retrieved from a lookup table, each of the first determined power level and the second determined power level may be retrieved from a lookup table, as is given below:

| | STAGE A | | STAGE B | |
|---|---|---|---|---|
| Temperature Setpoint [° F.] | Preheat Power [%] | Preheat Duration [sec] | Preheat Power [%] | Preheat Duration [sec] |
| 100 | 5 | 60 | 3 | 90 |
| 150 | 16 | 60 | 9 | 90 |
| 250 | 28 | 60 | 15 | 90 |
| 350 | 40 | 60 | 22 | 90 |
| 450 | 51 | 60 | 29 | 90 |

As can be seen, a unique predetermined power level for stage A and a unique predetermined power level for stage B may be stored for individual temperature setpoints. Further, as would be understood, each of the first predetermined power level and the second predetermined power level may be determined according to one or more equations. For instance, similar to the example given above, each of the first predetermined power level and the second predetermined power level may be determined according to an interpolation of two known power levels. As would be understood, the interpolation may be linear interpolation or nonlinear interpolation. Additionally or alternatively, one or more of the plurality of stages may include a determined power level of zero (e.g., 0%), during which the heating element is not operated.

At step 206, method 200 may include initiating the preheating phase by directing the at least one heating element according to the at least one determined attribute. Upon determining the attribute or attributes for the heating element (e.g., power level, duration, etc.), the method 200 may initiate or begin the preheating phase of the cooking operation. Thus, the at least one heating element may be directed at the determined power level [or first determined power level over the first duration (e.g., stage A)]. According to some embodiments, as described above, the at least one heating element may then be directed at the second determined power level over the second duration (e.g., stage B). The method may monitor (e.g., time) the duration of the preheating phase. Upon completion of the preheating phase, the cooking appliance may enter a standby phase. In the standby phase, the cooking appliance may emit an alert (e.g., via a tone, an alarm, a notification, etc.) to the user to indicate that the preheating has been completed. In some embodiments, the cooking appliance may automatically initiate the cooking phase of the cooking (or heating) operation.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A cooking appliance defining a vertical direction, a lateral direction, and a transverse direction, the cooking appliance comprising:

at least one heating element to selectively supply heat to a cookware item; and a controller operably connected with the at least one heating element, the controller configured to direct a heating operation comprising a preheating phase and a cooking phase, wherein directing the heating operation comprises:

receiving a temperature setpoint for the cooking phase;

determining a power level of the at least one heating element for the preheating phase based on the temperature setpoint, wherein determining the power level comprises retrieving the power level from a lookup table comprising a plurality of power levels; and initiating the preheating phase by directing the at least one heating element according to the determined power level.

2. The cooking appliance of claim 1, wherein the at least one heating element comprises a plurality of heating elements, wherein the lookup table comprises a plurality of unique lookup tables, and wherein each of the plurality of heating elements is associated with a unique lookup table of the plurality of unique lookup tables.

3. The cooking appliance of claim 1, wherein determining the power level of the at least one heating element comprises:

performing one or more equations based on the temperature setpoint and two or more known power levels to interpolate the power level.

4. The cooking appliance of claim 1, wherein the at least one heating element is directed at the determined power level for a predetermined length of time, the predetermined length of time being a duration of the preheating phase.

5. The cooking appliance of claim 1, wherein the preheating phase comprises at least a first stage having a first duration and a second stage having a second duration and performed after the first stage.

6. The cooking appliance of claim 5, wherein the determined power level of the at least one heating element comprises:

a first determined power level for the first stage; and a second determined power level for the second stage, the second determined power level being different from the first determined power level.

7. The cooking appliance of claim 6, wherein initiating the preheating phase comprises:

directing the at least one heating element at the first determined power level for the first duration; and directing the at least one heating element at the second determined power level for the second duration.

8. A method of operating a cooking appliance, the cooking appliance comprising at least one heating element, the method comprising:

receiving a temperature setpoint for a cooking operation, the cooking operation comprising a preheating phase and a cooking phase;

determining a power level of the at least one heating element for the preheating phase based on the temperature setpoint, wherein determining the power level comprises retrieving the power level from a lookup table comprising a plurality of power levels; and initiating the preheating phase by directing the at least one heating element according to the determined power level.

9. The method of claim 8, wherein the at least one heating element comprises a plurality of heating elements, wherein the lookup table comprises a plurality of unique lookup tables, and wherein each of the plurality of heating elements is associated with a unique lookup table of the plurality of unique lookup tables.

10. The method of claim 8, wherein determining the power level of the at least one heating element comprises:

performing one or more equations based on the temperature setpoint and two or more known power levels to interpolate the power level.

11. The method of claim 8, wherein the at least one heating element is directed at the determined power level for a predetermined length of time, the predetermined length of time being a duration of the preheating phase.

12. The method of claim 8, wherein the preheating phase comprises at least a first stage having a first duration and a second stage having a second duration and performed after the first stage.

13. The method of claim 12, wherein the determined power level of the at least one heating element comprises:

a first determined power level for the first stage; and a second determined power level for the second stage, the second determined power level being different from the first determined power level.

14. The method of claim 13, wherein initiating the preheating phase comprises:

directing the at least one heating element at the first determined power level for the first duration; and directing the at least one heating element at the second determined power level for the second duration.

* * * * *